US007843415B2

(12) United States Patent
Kim et al.

(10) Patent No.: US 7,843,415 B2
(45) Date of Patent: Nov. 30, 2010

(54) LIQUID CRYSTAL DISPLAY DEVICE AND METHOD OF DRIVING SAME

(75) Inventors: Do-Kyung Kim, Gyeonggi-do (KR); Hyun-Young Park, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 806 days.

(21) Appl. No.: 11/759,280

(22) Filed: Jun. 7, 2007

(65) Prior Publication Data

US 2007/0285693 A1 Dec. 13, 2007

(30) Foreign Application Priority Data

Jun. 9, 2006 (KR) ..... 10-2006-0051781

(51) Int. Cl.
*G09G 3/36* (2006.01)
*G09G 5/10* (2006.01)

(52) U.S. Cl. ..... 345/89; 345/690

(58) Field of Classification Search ..... 345/89, 345/98, 690

See application file for complete search history.

(56) References Cited

U.S. PATENT DOCUMENTS

2002/0097208 A1* 7/2002 Hashimoto ..... 345/98

FOREIGN PATENT DOCUMENTS

| | | | |
|---|---|---|---|
| JP | 2000-122596 | | 4/2000 |
| KR | 10-2001-0007353 | | 1/2001 |
| KR | 10-2003-0011613 | | 2/2003 |
| KR | 1020030020694 | A | 3/2003 |
| KR | 1020040013961 | A | 2/2004 |
| KR | 1020040085015 | A | 10/2004 |
| KR | 1020050062855 | A | 6/2005 |

* cited by examiner

*Primary Examiner*—Kevin M Nguyen
(74) *Attorney, Agent, or Firm*—Volentine & Whitt, PLLC

(57) ABSTRACT

A source driver includes a control unit, a data selecting unit, a gamma circuit, a level shifter and a driving buffer unit. The control unit compares a frame count value with a predetermined value N, where N is a natural number larger than two, and outputs a data select signal and a driver control signal based on the comparison. The data selecting unit outputs one of input data and black data in response to the data select signal. The gamma circuit generates a grayscale voltage based on selected data from the data selecting unit and the level shifter generates a driving voltage based on the grayscale voltage. The driving buffer unit provides an output voltage based on the driving voltage to a data line of a display device in response to the driver control signal. Accordingly, the source driver prevents afterimages, improves moving image quality and reduces power consumption

21 Claims, 6 Drawing Sheets

LIQUID CRYSTAL DISPLAY DEVICE AND METHOD OF DRIVING SAME

BACKGROUND OF THE INVENTION

1. Field of the Invention

Embodiments of the invention relate to a display device. More particularly, embodiments of the invention relate to a source driver, a liquid crystal display (LCD) device, and a method of driving a data line of an LCD.

This U.S. non-provisional application patent application claims priority under 35 USC §119 of Korean Patent Application No. 2006-51781 filed on Jun. 9, 2006 the entire contents of which are hereby incorporated by reference.

2. Discussion of Related Art

Liquid crystal display (LCD) devices are widely used in imaging devices such as digital video cameras, digital still cameras, computer monitors and television displays. LCDs are also used in portable electronic devices such as cellular phones, and personal digital assistants (PDAS) to display images and/or text information. An LCD device may display an image by using optical anisotropy of liquid crystal. The LCD device has advantages such as thinness, small size, low power consumption and high resolution to be developed as a flat display device which replaces a cathode ray tube (CRT). However, the LCD device has relatively low quality with respect to moving images as compared to conventional CRTs.

Generally, a response time of an LCD device is longer than a frame display period (about 16.7 ms) due to viscosity which is an elastic force of a liquid crystal molecule. The response time corresponds to a time from when an electric field is applied to the liquid crystal molecules to when a predetermined transmittance is obtained by changing an arrangement of the liquid crystal molecules. The long response time may not influence an image or a moving image when a luminance change of an image is small from frame to frame, but may compromise a moving image in which the luminance change of the image is large from frame to frame. In the latter instance, the actual luminance of pixels may not reach a desirable level and then may be changed according to a signal associated with the next frame. Thus, degradation of image quality such as image contrast may result.

An LCD device is driven using a hold-type method where charges accumulated in the liquid crystal molecules due to the electric field are maintained at a high ratio until the next electric field is applied. Thus, each pixel of the LCD device maintains emission until the signal of the next frame is applied. When images representing moving objects are displayed from frame to frame, an afterimage of the object of the previous frame remains when the next frame image is processed. Accordingly, motion blurring may result where the object is not moving, but appears to be stretched.

An impulsive-type driving method which inserts a black or white screen for a short time is one way to solve this problem. The impulsive-type driving method includes an impulsive emission type and a cyclic resetting type. In the impulsive emission type, a backlight is turned off with a predetermined period so that the whole screen becomes black. In the cyclic resetting type, a black data voltage or a white data voltage is applied to the pixels with a predetermined period along with a normal data voltage.

According to flexible black data insertion technology, a frame frequency is twice a conventional frequency (120 Hz) and a frame time is half of a conventional time (8.3 ms). In addition, a maximum level of 50% of black data is inserted according to a luminance to improve the moving image quality. In particular, in the hold-type driving method data in one frame is divided into two frames at 60 Hz. An image, lighter than an original image, is allocated to one frame and a darker image including black data is allocated to the other frame. Thus, the two frames have the same luminance by integrating the two frames by time. However, this method requires high power consumption due to high operation speed. As a result, the technology is not applicable for small and medium-size display devices used in cellular phones and similar devices. In addition, it may be required to insert black data at different frame rates depending on the type of display panel used in order to prevent afterimages due to individual panel characteristics.

SUMMARY OF THE INVENTION

Exemplary embodiments of the present invention are directed to a liquid crystal display device. In an exemplary embodiment, the LCD device includes an LCD panel, a gate driver and a source driver. The LCD panel includes a plurality of gate lines and a plurality of data lines. The gate driver drives the plurality of gate lines. The source driver drives the plurality of data lines and includes a control unit configured to compare a frame count value with a predetermined value N, N being a natural number larger than two. The control unit is also configured to output a data select signal and a driver control signal based on the resulting comparison. A data selecting unit is connected to the control unit and configured to output one of input data and black data in response to the data select signal. A gamma circuit is connected to the data selecting unit and configured to generate a grayscale voltage based on selected data from the data selecting unit. A level shifter is connected to the gamma circuit and configured to generate a driving voltage based on the grayscale voltage. A driving buffer unit is disposed between the level shifter and the control unit. The driving buffer unit provides an output voltage based on the driving voltage to a data line of a display device in response to the driver control signal.

DESCRIPTION OF EMBODIMENTS

Figure 1:
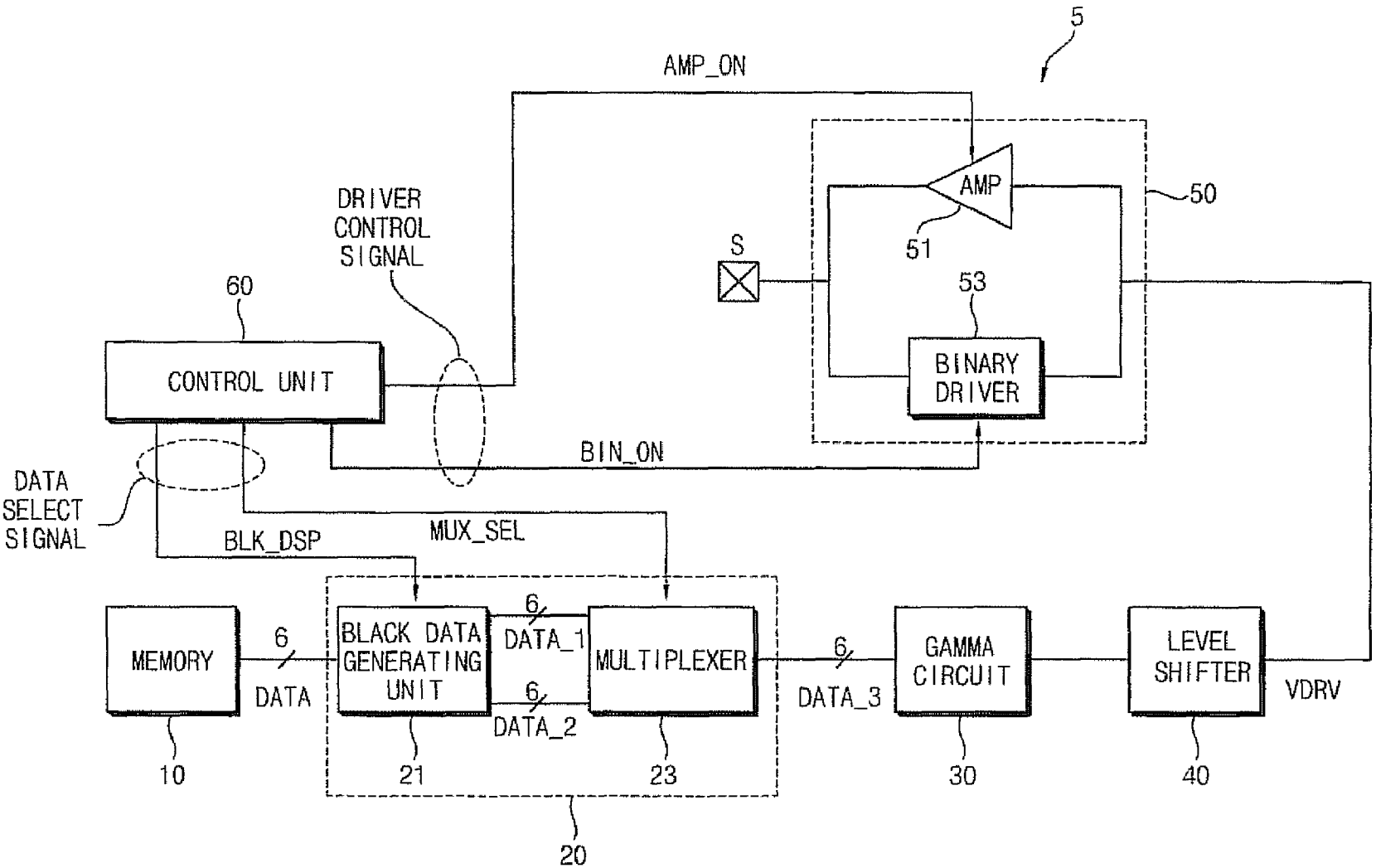
FIG. 1 is a block diagram illustrating a source driver according to an example embodiment of the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

FIG. 1 is a block diagram illustrating a source driver 5 including memory 10, data selecting unit 20, gamma circuit 30, level shifter 40, driving buffer unit 50 and control unit 60. Data selecting unit 20 includes black data generating unit 21 and multiplexer 23. Memory 10 provides input data DATA to data selecting unit 20. Input data DATA may be, for example, serial RGB image data where each of the serial RGB image data may correspond to 6-bit data. One pixel may display 64 gray scales, and the serial RGB image data may display more than 260,000 gray scales.

Control unit 60 provides data select signals that include a black data display signal BLK_DSP and a multiplexer selecting signal MUX_SEL. Control unit 60 also provides driver control signals that include a binary driver control signal BIN_ON and an amplifier control signal AMP_ON. Black data generating unit 21 is controlled by black data display signal BLK_DSP and multiplexer 23 is controlled by multiplexer selecting signal MUX_SEL. Binary driver 53 is controlled by binary driver control signal BIN_ON and amplifier 51 is controlled by amplifier control signal AMP_ON.

Figure 2:
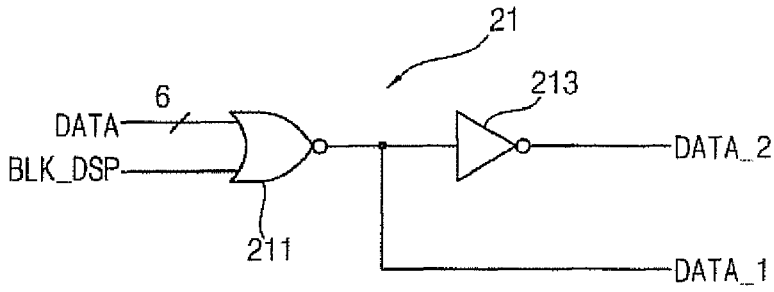
FIG. 2 is a circuit diagram illustrating a black data generating unit in the source driver of FIG. 1.

FIG. 2 is a circuit diagram illustrating a black data generating unit 21 including NOR gate 211 and inverter 213. Black data generating unit 21 receives input data DATA from memory 10 and receives black data display signal BLK_DSP from control unit 60. NOR gate 211 performs a logic NOR operation on input data DATA and black data display signal BLK_DSP to output first data DATA_1. Inverter 213 inverts first data DATA_1 to output second data DATA_2. When black data display signal BLK_DSP is not activated, input data DATA is outputted as second data DATA_2. When black data display signal BLK_DSP is activated, black data is outputted as second data DATA_2. For example, when black data display signal BLK_DSP is a logic "0", first data DATA_1 corresponds to data inverted from the input data DATA and the second data DATA_2 corresponds to input data DATA. When black data display signal BLK_DSP is a logic "1", first data DATA_1 corresponds to "000000" and second data DATA_2 corresponds to "111111" regardless of input data DATA.

Referring to FIGS. 1 and 2, multiplexer 23 receives first data DATA_1 and second data DATA_2 from black data generating unit 21 and receives multiplexer selecting signal MUX_SEL from control unit 60. Multiplexer 23 selects one of the first data DATA_1 and second data DATA_2 in response to multiplexer selecting signal MUX_SEL. For example, when multiplexer selecting signal MUX_SEL is logic "0", multiplexer 23 selects second data DATA_2 and outputs it as third data DATA_3. When multiplexer selecting signal MUX_SEL is logic "1", multiplexer 23 selects first data DATA_1 and outputs it as third data DATA_3. In another example, when multiplexer signal MUX_SEL is logic "0", multiplexer 23 selects first data DATA_1 and outputs it as third data DATA_3. When multiplexer selecting signal MUX_SEL is logic "1", multiplexer 23 selects second data DATA_2 and outputs it as third data DATA_3.

Gamma circuit 30 receives third data DATA_3 from multiplexer 23 and outputs a grayscale voltage for displaying gray scales in an LCD device. Gamma circuit 30 may include a plurality of resistors serially coupled with each other between a power supply voltage and a ground voltage. Each voltage at each node of the plurality of resistors may be used as the grayscale voltage. When third data DATA_3 corresponds to 6-bit data, gamma circuit 30 outputs 64 (ie. 26) grayscale voltages. That is, when m-bit data is inputted, gamma circuit 30 outputs $2^m$grayscale voltages.

Level shifter 40 receives the grayscale voltage from gamma circuit 30, amplifies the grayscale voltage to be properly applied to driving buffer unit 50, and then outputs a driving voltage VDRV. Driving buffer unit 50 receives the driving voltage VDRV from level shifter 40 and provides an output to a data line of a display device. Driving buffer unit 50 includes amplifier 51 and binary driver 53. Amplifier 51 receives amplifier control signal AMP_ON from control unit 60 and binary driver 53 receives binary driver control signal BIN_ON from control unit 60. For example, when amplifier control signal AMP_ON is logic "1" and binary driver control signal BIN_ON is logic "0", driving voltage VDRV is applied to amplifier 51. Driving voltage VDRV is generated in level shifter 40 according to 64 gray scales based on 6-bit data. Amplifier 51 amplifies driving voltage VDRV to provide an amplified voltage to the data line of the display device. When the amplifier control signal AMP_ON is logic "0" and binary driver control signal BIN_ON is logic "1", driving voltage VDRV is applied to binary driver 53.

Figure 3:
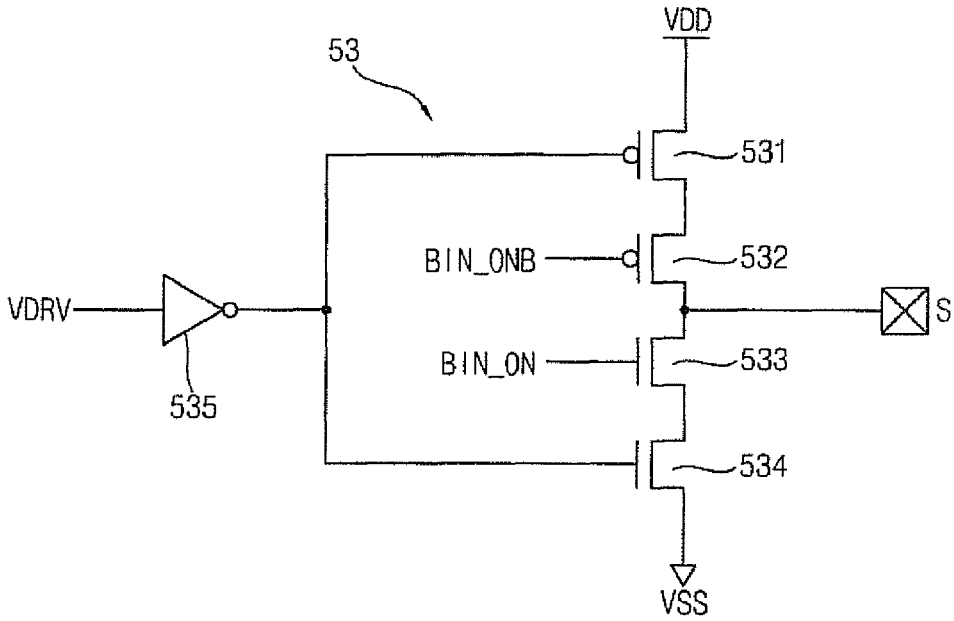
FIG. 3 is a circuit diagram illustrating a binary driver in the source driver of FIG. 1.

FIG. 3 is a circuit diagram illustrating binary driver 53 in source driver 5 shown in FIG. 1. Binary driver 53 includes first p-type metal-oxide semiconductor (PMOS) transistor 531, second PMOS transistor 532, first n-type MOS (NMOS) transistor 533, second NMOS transistor 534 and inverter 535 connected to the gates of PMOS transistor 531 and second NMOS transistor 534. When the binary driver control signal BIN_ON is logic "1", second PMOS transistor 532 and first NMOS transistor 533 are turned on. Inverter 535 inverts the driving voltage VDRV and provides the voltage to gates of the first PMOS transistor 531 and the second NMOS transistor 534. When the output of inverter 535 is logic "1", first PMOS transistor 531 is turned off and second NMOS transistor 534 is turned on. Thus, binary driver 53 provides ground voltage VSS to the data line of the display device. When the output of inverter 535 is logic "0", first PMOS transistor 531 is turned on and second NMOS transistor 534 is turned off. Thus, binary driver 53 provides supply voltage VDD to the data line of the display device. In this manner, while black data is inserted, amplifier 51 is disabled and binary driver 53 is enabled so as to reduce power consumption.

Figure 4:
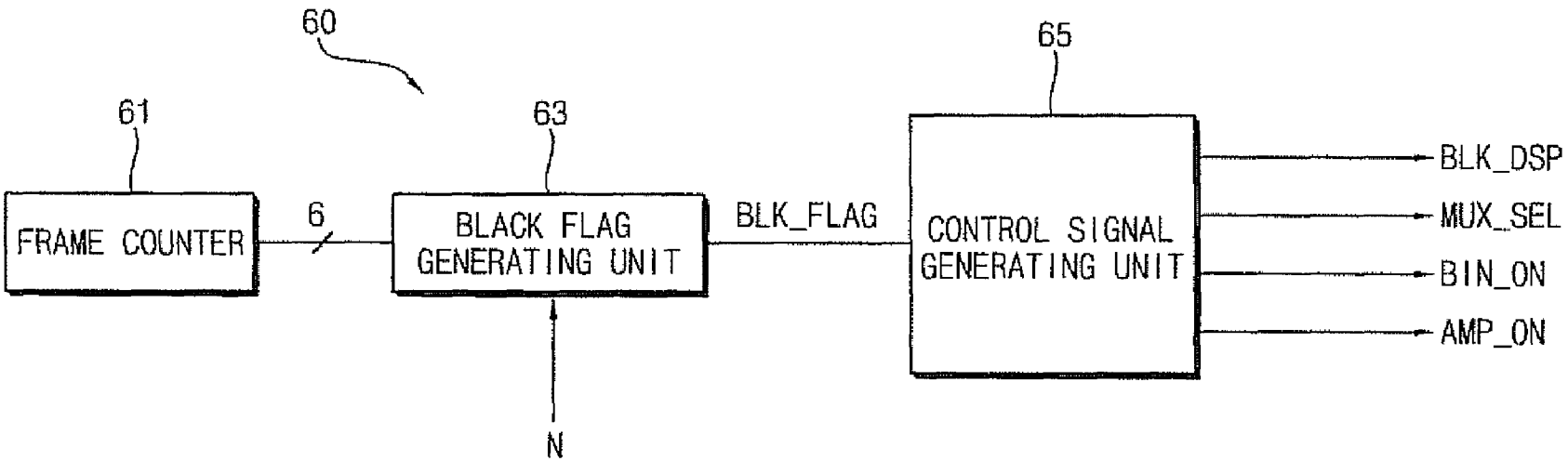
FIG. 4 is a block diagram illustrating a control unit in the source driver of FIG. 1.
Figure 5:
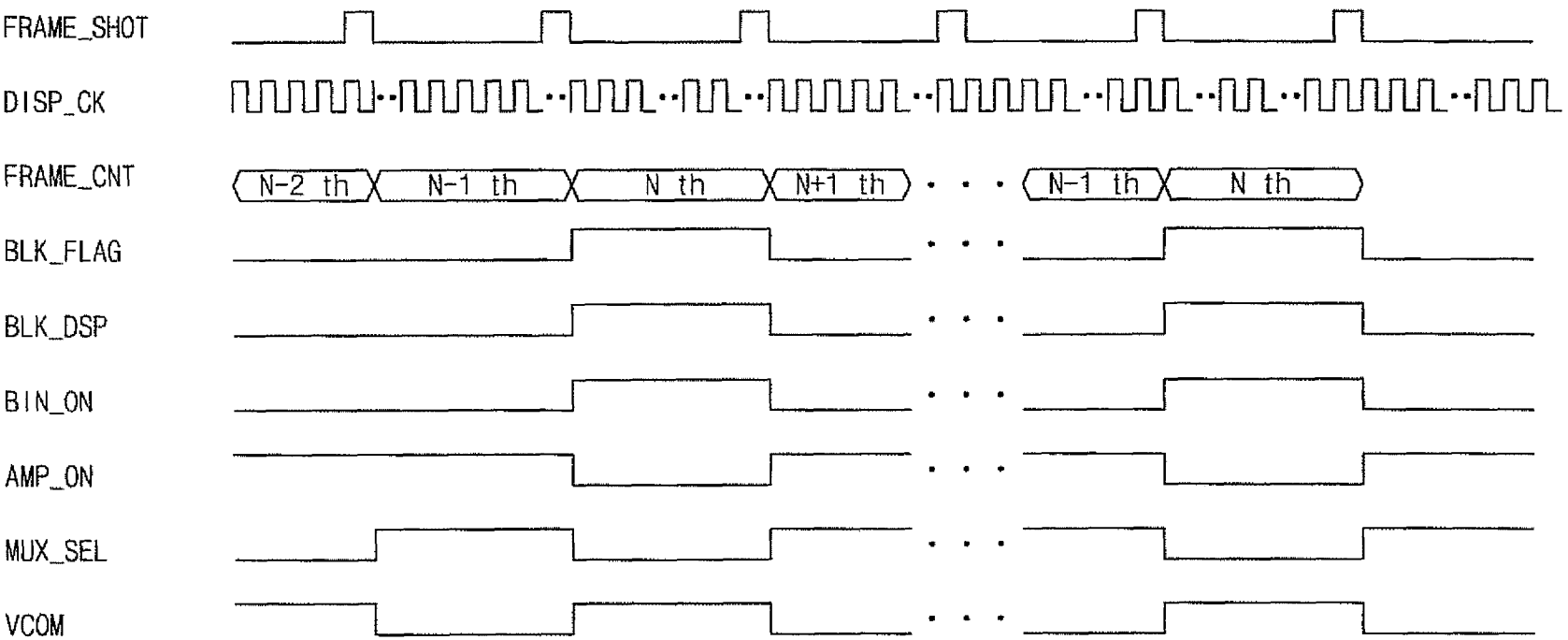
FIG. 5 is a timing diagram illustrating the operation of the control unit in FIG. 4.

FIG. 4 is a block diagram illustrating control unit 60 in source driver 5 of FIG. 1 and FIG. 5 is an associated timing diagram illustrating the operation of control unit 60. Control unit 60 includes frame counter 61, black flag generating unit 63 and control signal generating unit 65. Frame counter 61 counts a frame FRAME_SHOT as 0, 1, 2, 3, 4, 5, 0, 1, 2, . . . in synchronization with display clock signal DISP_CK (FIG. 5) to provide a count result to black flag generating unit 63. Black flag generating unit 63 outputs a black flag BLK_FLAG signal when the count result is the same as a predetermined value N where N is a natural number larger than two. Predetermined value N may be modified by setting a value of a register (not shown). Control signal generating unit 65 outputs black data display signal BLK_DSP, multiplexer selecting signal MUX_SEL, binary driver control signal BIN_ON and amplifier control signal AMP_ON based on the black flag BLK_FLAG signal.

When black flag BLK_FLAG signal is logic "0", black data display signal BLK_DSP is logic "0". Thus, input data DATA is outputted as second data DATA_2 from black data generating unit 21 (FIG. 1) and applied to the data line of the display device. When black flag BLK_FLAG is logic "1", black data display signal BLK_DSP is logic "1". Thus, black data is outputted from black data generating unit 21 regardless of the input data DATA. In this case, multiplexer selecting signal MUX_SEL is logic "0" and then multiplexer 23 outputs the second data DATA_2 of the black data generating unit 21. In addition, when binary driver control signal BIN_ON is logic "1" and amplifier control signal AMP_ON is logic "0", binary driver 53 is enabled and amplifier 51 is disabled. Thus, binary driver 53 receives driving voltage VDRV from level shifter 40 and provides supply voltage VDD or ground voltage VSS to the data line of the display device.

For example, a normally white panel may be used so that the black data is displayed when a maximum voltage is applied. Thus, when a common voltage VCOM is logic "high," multiplexer selecting signal MUX_SEL is logic "0". Alternatively, a normally black panel may be used. As another example, a frame inversion may be performed with respect to common voltage VCOM. In yet another example, a line inversion or a dot inversion may be performed with respect to common voltage VCOM.

Figure 6:
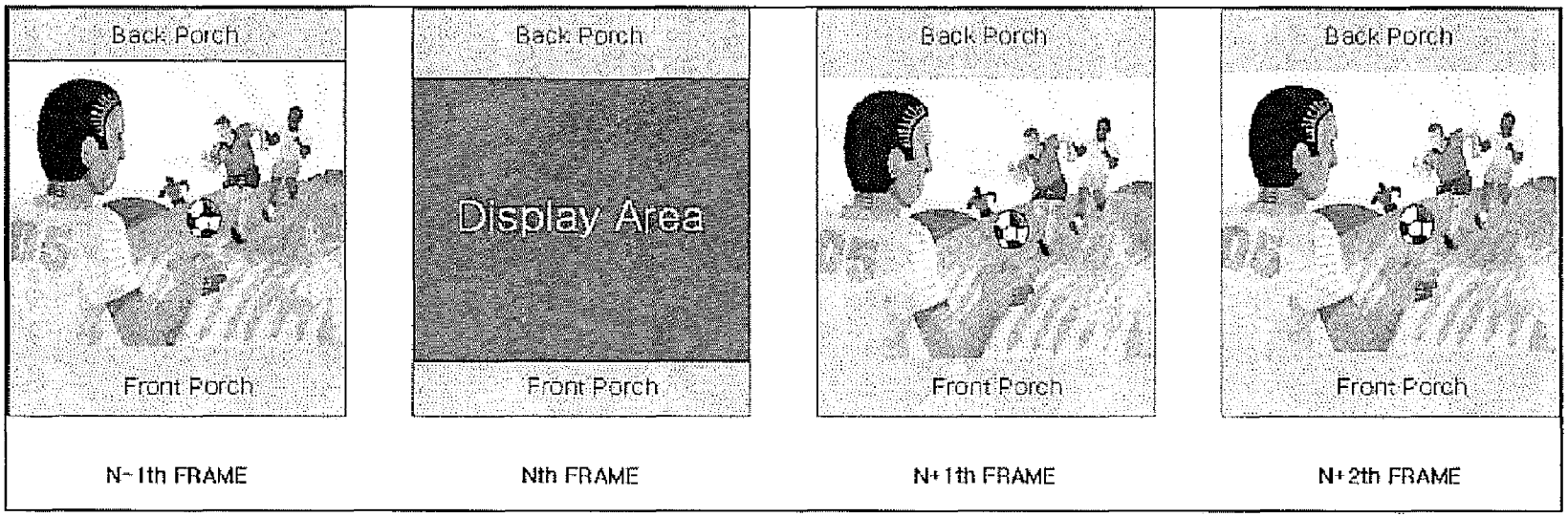
FIG. 6 is a view illustrating a black data insertion according to an example embodiment of the present invention.

FIG. 6 illustrates black data insertion according to an examplary embodiment where black data is displayed once for every M+1 frames (M is a natural number) and received image data is displayed in the other frames. For example, when M is fixed to '1', the black data is displayed every second frame regardless of the received image data. When M is fixed to '59', the black data is displayed every 60th frame regardless of the received image data. The black data is displayed by fixing a predetermined value M according to a frame rate such that afterimages due to characteristics of a panel may be prevented and power consumption may be reduced. In this manner, the source driver according to an exemplary embodiment of the present invention may be effectively applied to a small and medium-sized display device.

Figure 7:
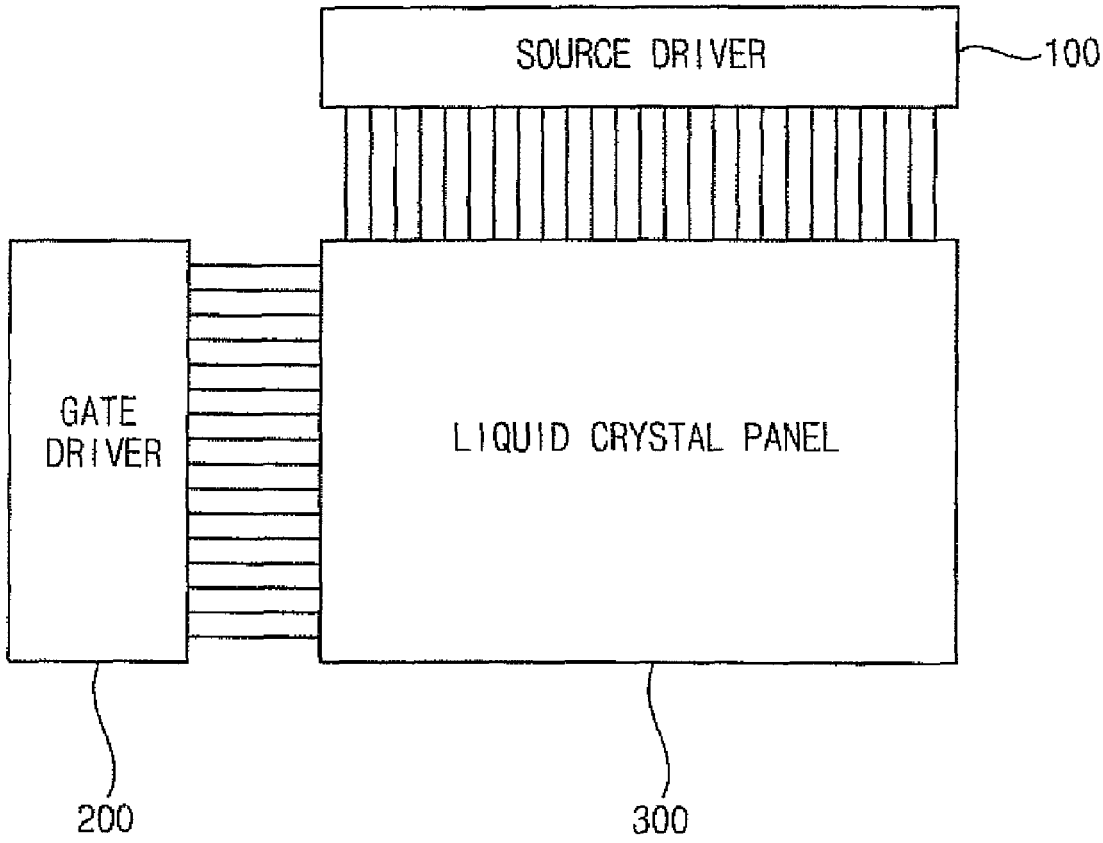
FIG. 7 is a block diagram illustrating a liquid crystal display (LCD) device including a source driver according to an example embodiment of the present invention.

FIG. 7 is a block diagram illustrating an LCD device including a source driver 100, gate driver 200 and an LCD panel 300. Source driver 100 may be the source driver shown in FIG. 1. As described above, source driver 100 may also include a control unit, a black data generating unit, a multiplexer, a gamma circuit, a level shifter and a driving buffer unit. The control unit outputs a black data display signal, a multiplexer selecting signal, a first driver control signal and a second driver control signal. The black data generating unit outputs input data or black data in response to the black data display signal. The multiplexer selects one of the input data and the black data in response to the multiplexer selecting signal. Gamma circuit outputs a grayscale voltage based on selected data and the level shifter outputs a driving voltage based on the grayscale voltage. The driving buffer unit provides an output voltage based on the driving voltage to a data line of the LCD device in response to the first driver control signal and may provide a supply voltage to the data line of the LCD device in response to the second driver control signal. In another example embodiment, source driver 100 and gate driver 200 may be implemented in one chip.

As mentioned above, the source driver, the LCD device, and the method of driving the data line of the LCD device according to an embodiment of the present invention provides for the insertion of black data at a desirable frame rate based on panel characteristics so that afterimages are prevented, the quality of a moving image is improved and power consumption is reduced.

Although the present invention has been described in connection with the embodiment of the present invention illustrated in the accompanying drawings, it is not limited thereto. It will be apparent to those skilled in the art that various substitution, modifications and changes may be made thereto without departing from the scope and spirit of the invention.

What is claimed is:

1. A source driver comprising:

a control unit configured to compare a frame count value with a predetermined value N, N being a natural number larger than two, said control unit configured to output a data select signal and a driver control signal based on said comparison, said data select signal including a black data display signal and a multiplexer selecting signal;

a data selecting unit connected to said control unit, configured to output one of input data and black data in response to said data select signal, and comprising; a black data generating unit configured to perform a logic operation on the input data and the black data display signal to generate first data and inverted first data, said first data being one of the input data and the black data, and a multiplexer connected to said black data generating unit and configured to select one of the first data and the inverted first data in response to said multiplexer selecting signal to output selected data as second data;

a gamma circuit connected to said data selecting unit and configured to generate a grayscale voltage based on selected data from said data selecting unit;

a level shifter connected to said gamma circuit and configured to generate a driving voltage based on said grayscale voltage; and a driving buffer unit disposed between said level shifter and said control unit, said driving buffer unit configured to provide an output voltage based on said driving voltage to a data line of a display device in response to said driver control signal.

2. The source driver of claim 1, wherein said first data is substantially the same as the input data when the black data display signal is not activated, and is substantially the same as the black data when the black data display signal is activated.

3. The source driver of claim 2, wherein said black data generating unit further comprises:

a first buffer configured to receive the input data and the black data display signal and output inverted first data; and a second buffer connected to an output of said first buffer and configured to receive an output of said first buffer and output the first data.

4. The source driver of claim 3, wherein said first buffer is a NOR gate and said second buffer is an inverter.

5. The source driver of claim 1, wherein said control unit further comprises:

a frame counter configured to count an input frame and output a frame count value;

a black flag generating unit connected to said frame counter and configured to generate a black flag signal when said frame count value is the same as said predetermined value N; and a control signal generating unit connected to said black flag generating unit and configured to generate the black data display signal, the multiplexer selecting signal and the driver control signal based on said black flag signal.

6. The source driver of claim 5, wherein said driver control signal includes a first driver control signal and a second driver control signal, said black data display signal and said second driver control signal are activated and said multiplexer selecting signal and said first driver control signal are not activated when the black flag is activated.

7. The source driver of claim 6, wherein said driving buffer unit further comprises:

a first driver configured to amplify said driving voltage when said first driver control signal is activated; and a second driver configured to receive said driving voltage to output a higher supply voltage or a ground voltage when said second driver control signal is activated.

8. The source driver of claim 7, wherein said second driver further comprises:

an inverter configured to receive said driving voltage;

a first p-type metal-oxide semiconductor (PMOS) transistor having a gate coupled to an output terminal of said inverter and a source coupled to the higher supply voltage;

a second PMOS transistor having a gate that receives an inverted signal from said second driver control signal, a source coupled to a drain of said first PMOS transistor, and a drain coupled to the data line of the display device;

a first n-type MOS (NMOS) transistor having a gate that receives the second driver control signal and a drain coupled to the drain of said second PMOS transistor; and a second NMOS transistor having a gate coupled to the output terminal of said inverter, a drain coupled to a source of said first NMOS transistor, and a source coupled to the ground voltage.

9. A liquid crystal display (LCD) device comprising:

an LCD panel including a plurality of gate lines and a plurality of data lines;

a gate driver configured to drive the plurality of gate lines; and a source driver configured to drive the plurality of data lines, said source driver comprising:

a control unit configured to compare a frame count value with a predetermined value N, N being a natural number larger than two, said control unit configured to output a data select signal and a driver control signal based on a comparison result, said data select signal including a black data display signal and a multiplexer selecting signal;

a data selecting unit coupled to said control unit, configured to output one of input data and black data in response to said data select signal, and comprising: a black data generating unit configured to perform a logic operation on the input data and the black data display signal to generate first data and inverted first data, said first data being one of the input data and the black data; and a multiplexer connected to said control unit and configured to select one of the first data and the inverted first data in response to the multiplexer selecting signal and output selected data as second data ;

a gamma circuit coupled to said data selecting unit and configured to generate a grayscale voltage based on selected data from said data selecting unit;

a level shifter coupled to said gamma circuit and configured to generate a driving voltage based on said grayscale voltage; and a driving buffer unit configured to provide an output voltage based on said driving voltage to the plurality of data lines in response to said driver control signal.

10. The LCD device of claim 9, wherein said first data is substantially the same as the input data when the black data display signal is not activated, and is substantially the same as the black data when the black data display signal is activated.

11. The LCD device of claim 10, wherein said black data generating unit further comprises:

a first buffer configured to receive the input data and the black data display signal and output inverted first data; and a second buffer coupled to an output of said first buffer and configured to output the first data.

12. The LCD device of claim 11, wherein said first buffer is a NOR gate and said second buffer is an inverter.

13. The LCD device of claim 9, wherein said control unit further comprises:

a frame counter configured to count an input frame and output a frame count value;

a black flag generating unit connected to said frame counter and configured to generate a black flag signal when said frame count value is the same as said predetermined value N; and a control signal generating unit connected to said black flag generating unit and configured to generate the black data display signal, the multiplexer selecting signal and the driver control signal based on said black flag signal.

14. The LCD device of claim 13, wherein said driver control signal includes a first driver control signal and a second driver control signal, said black data display signal and said second driver control signal are activated and said multiplexer selecting signal and said first driver control signal are not activated when the black flag is activated.

15. The LCD device of claim 14, wherein said driving buffer unit further comprises:

a first driver configured to amplify said driving voltage when said first driver control signal is activated; and a second driver configured to receive said driving voltage to output a higher supply voltage or a ground voltage when said second driver control signal is activated.

16. The LCD device of claim 15, wherein said second driver further comprises:

an inverter configured to receive said driving voltage;

a first p-type metal-oxide semiconductor (PMOS) transistor having a gate coupled to an output terminal of said inverter and a source coupled to the higher supply voltage;

a second PMOS transistor having a gate that receives an inverted signal from said second driver control signal, a source coupled to a drain of said first PMOS transistor, and a drain coupled to the data line of the display device;

a first n-type MOS (NMOS) transistor having a gate that receives the second driver control signal and a drain coupled to the drain of said second PMOS transistor; and a second NMOS transistor having a gate coupled to the output terminal of said inverter, a drain coupled to a source of said first NMOS transistor, and a source coupled to the ground voltage.

17. A method of driving a data line of a display device, the method comprising:

comparing a frame count value with a predetermined value N where N is a natural number larger than two;

outputting a data select signal and a driver control signal based on the comparison, said data select signal including a black data display signal and a multiplexer selecting signal;

outputting one of input data and black data in response to the data select signal by performing a logic operation on the input data and the black data display signal to generate first data and inverted first data, said first data being one of the input data and the black data, and selecting one of the first data and the inverted first data in response to the multiplexer selecting signal to output selected data as second data;

generating a grayscale voltage based on outputted data;

generating a driving voltage based on the grayscale voltage; and providing an output voltage based on the driving voltage to the data line of the display device in response to the driver control signal.

18. The method of claim 17, wherein the first data is substantially the same as the input data when said black data display signal is not activated, and is substantially the same as said black data when said black data display signal is activated.

19. The method of claim 18, wherein outputting the data select signal and the driver control signal further comprises:

counting an input frame;

outputting the frame count value;

generating a black flag signal when said frame count value is the same as the predetermined value N; and generating the black data display signal, the multiplexer selecting signal and the driver control signal based on said black flag signal.

20. The method of claim 19, wherein the driver control signal includes a first driver control signal and a second driver control signal, said method further comprising:

activating said black data display signal and said second driver control signal; and when the black flag is activated, not activating said multiplexer selecting signal and said first driver control signal.

21. The method of claim 20, wherein providing the output voltage further comprises:

amplifying the driving voltage when said first driver control signal is activated; and receiving the driving voltage to output a higher supply voltage or a ground voltage when said second driver control signal is activated.

* * * * *